US005694653A

United States Patent [19]

Harald

[11] Patent Number: 5,694,653

[45] Date of Patent: Dec. 9, 1997

[54] WATER CONTROL SENSOR APPARATUS AND METHOD

[76] Inventor: Phillipp Harald, 651 Holiday Dr., Bldg. 5, Suite 300, Pittsburgh, Pa. 15220

[21] Appl. No.: 360,665

[22] PCT Filed: Jun. 18, 1993

[86] PCT No.: PCT/US93/05885

§ 371 Date: Dec. 19, 1994

§ 102(e) Date: Dec. 19, 1994

[87] PCT Pub. No.: WO94/00645

PCT Pub. Date: Jan. 6, 1994

Related U.S. Application Data

[63] Continuation-in-part of Ser. No. 900,114, Jun. 18, 1992, abandoned.

[51] Int. Cl.[6] ..... E03C 1/05

[52] U.S. Cl. ..... 4/623; 4/559; 4/597; 4/676; 4/678

[58] Field of Search ..... 4/302, 304, 305, 4/313, DIG. 3, 623, 559, 597, 598, 675, 676, 678

[56] References Cited

U.S. PATENT DOCUMENTS

| | | | |
|---|---|---|---|
| 3,505,692 | 4/1970 | Forbes | 4/623 |
| 3,551,919 | 1/1971 | Forbes | 4/623 |
| 3,585,653 | 6/1971 | Forbes et al. | 4/623 |
| 4,237,421 | 12/1980 | Waldron | 340/562 |
| 4,295,132 | 10/1981 | Burney et al. | 340/562 |
| 4,688,277 | 8/1987 | Kakinoki et al. | 4/623 |
| 4,742,583 | 5/1988 | Yoshida et al. | 4/304 |
| 4,921,211 | 5/1990 | Novak et al. | 4/623 |
| 5,081,406 | 1/1992 | Hughes et al. | 340/562 |
| 5,095,945 | 3/1992 | Jensen | 251/129.04 |

*Primary Examiner*—Henry J. Recla
*Assistant Examiner*—Charles R. Eloshway

[57] ABSTRACT

The invention comprises an apparatus and method for the hands-free controlling of the on and off operation and temperature of the water flow from the spout (100) through the use of proximity sensors (10) that detect the proximity of a person's hand (H) relative to the spout. The spout (100) therefore functions as a transmitter antenna (170) to emit a time varying electrostatic (primary) field (Fp). When a portion of a person's body such as a hand (H) or finger enters the field, the primary field (Fp) is coupled to the person's body. The person's body then radiates a secondary field (Fs) in syncopation with the primary field (Fp). An antenna receiver (140) is located behind the front panel of the vanity of the sink (100) to receive the secondary field (Fs). Electronic circuitry (200) including a microprocessor with software then processes the received signal to perform the desired functions.

22 Claims, 13 Drawing Sheets

COMPOUT
U1:A
360
VCC
CLAMP
RAMP
R3
365
C6
C5
R5
355
Q2
350
SAMPLE
AMP SIGNAL

240
C1
GATED
R1 CLOCK
1.25
U1:B
240
C8
SAMPLE
R7
U3:A
VCC
R8

171a
100a
170a
C2
C3
C4
Z1
R4
Z2
R25
Z3
R26
U5:A
U5:D
U5:B
GATEDCLOCK
GATESPOUT
GATE WARMER
GATE COLDER
U5:C
CLOCK
CLOCK GATE

WATER CONTROL SENSOR APPARATUS AND METHOD

This is a continuation in part of application Ser. No. 07/900,114 filed Jun. 18, 1992 now abandoned.

BACKGROUND OF THE INVENTION

1. Field of the Invention

This invention relates to an apparatus and method for controlling the water flow from a spout and, more particularly, to an apparatus and method for the hands-free controlling of the on and off operation and temperature of the water flow from the spout through the use of proximity sensors that detect the proximity of a person's hand relative to the spout.

2. Description of the Background Art

Presently there exist many controllers for hands-free controlling of the on and off operation of the water flow from a spout through the use of proximity sensors that detect the proximity of a person's hand relative to the spout. More particularly, proximity controllers have commonly employed a microwave transmitter that emits a microwave radio frequency (RF) field and a microwave receiver that examines any doppler shifts in the RF field that are cause by a person's hands being in close proximity to the spout. The controller then activates a solenoid valve to turn on the water flow to the spout.

Probably the most common type of proximity controller is an optical controller that comprises a pulsed infrared emitter and detector together with processing electronics that are used to control one or two (e.g., hot and cold) solenoid valves. In these optical controllers, the reflections of an emitted pulsed infrared (IR) beam are sensed to determine whether to activate or deactivate the solenoid valves.

Pulsed optical controllers have been dominant largely due to their safety, relatively low power consumption, and low cost. Pulsed IR processing circuitry typically comprises a mixture of analog and digital components and in the case of more advanced controllers, microcomputers are employed.

Pulsed optical controllers either transmit the emitted IR beam in a substantially horizontal direction in order to detect the proximity of a person near the sink or transmit the IR beam in a downward direction in order to detect just the person's hands rather than his or her body. Pulsed optical controllers of either of these types suffer from sensitivity to color. Specifically, since the principle of IR sensing is one of reflectance, it follows that darkly reflecting surfaces are more difficult to detect than lighter surfaces. A person wearing dark, IR absorptive clothing at a sink having a horizontal beam controller may have difficulty being detected. Likewise, a person of dark skin color will have greater difficulty in being detected by a controller employing a downward IR beam. Also, both types of optical controllers require significant amounts of power to generate the required IR beam in order to be sensitive under most conditions, thereby commonly necessitating the use of line power to operate them as opposed to batteries, a factor which has in the past greatly limited their marketability.

In addition to the above drawbacks, optical controllers employing horizontal IR beams often activate the water flow whenever a person passes or idly stands by the sink. This disadvantageously results in large amounts of wasted water. Optical controllers employing downward looking IR beams often require a special spout construction with integrated optics and electronics, thereby making retrofits into existing installations cost prohibitive and raising the cost of new installations to levels which have reduced acceptance in the marketplace. Additionally, downward looking controllers usually have a fairly narrow sense field pattern, requiring the person to place his or her hands within a fairly small volume of space at the spout to be detected by the controller. Downward looking controllers are also plagued with numerous problems associated with looking into the sink; objects left in the sink, dirt accumulation, or standing water often grossly affects IR detection by changing sensitivity or by forcing prolonged durations of unwanted water flow.

In general, proximity controllers used in conjunction with sinks often suffer from one or more serious drawbacks, including the inability to allow for the selection of water temperature, the inability to allow for the control of water flow rate, the inability to provide for an intentional long water flow duration, (for example to allow for a sink or bucket to be filled), the lack of any feature to prevent scalding from excessively hot water, and the inability to be easily retrofitted into an existing installation without heavy modifications and a lengthy, labor-intensive installation process.

Therefore, it is an object of this invention to provide an improvement which overcomes the aforementioned inadequacies of the prior art devices and provides an improvement which is a significant contribution to the advancement of the proximity controller art.

Another object of this invention is to provide an improved proximity controller that emits a sense field which is broad enough to allow detection with wide tolerance to hand position.

Another object of this invention is to provide an improved proximity controller that does not sense a person's body and responds only when at least one of the person's hands is near the spout thereby restricting water flow only to those times when a demand for water is clearly indicated by the person.

Another object of this invention is to provide an improved proximity controller that is insensitive to color variations of the person's hand or clothing.

Another object of this invention is to provide an improved proximity controller that requires only small amounts of power to operate, so as to permit operation under battery or solar power for long periods of time.

Another object of this invention is to provide an improved proximity controller that does not require the use of a specially constructed spout, but can instead be used any ordinary spout.

Another object of this invention is to provide an improved proximity controller that may be easily retrofitted into an existing installation.

Another object of this invention is to provide an improved proximity controller that senses in an adaptive mode, wherein the controller can automatically compensate for changes in the environment near the sink without substantial changes in sensitivity and without causing prolonged unwanted water flow.

Another object of this invention is to provide an improved proximity controller that allows the person to select the water temperature.

Another object of this invention is to provide an improved proximity controller that allows the person to select the water flow rate.

Another object of this invention is to provide an improved proximity controller that allows a person to optionally engage the controller so as to provide for an intentionally prolonged flow of water.

Another object of this invention is to provide an improved proximity controller that can shut off or reduce the temperature of the water from the spout if the temperature exceeds a preset maximum thereby preventing scalding.

Another object of this invention is to provide an improved proximity controller that is simple to install thereby allowing for do-it-yourself installation by homeowners.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an apparatus and method for the hands-free controlling of the on and off operation and temperature of the water flow from the spout through the use of proximity sensors that detect the proximity of a person's hand relative to the spout. More particularly, the method and apparatus of the invention employs an electric field or capacitance sensing technique, whereby the spout itself or an area near it is excited by a very low time varying voltage at a suitable frequency. The spout therefore functions as a transmitter antenna to emit a time varying electric (primary) field. When a portion of a person's body such as a hand or finger enters the field, the primary field is coupled to the person's body. The person's body then radiates a secondary field in syncopation with the primary field. An antenna receiver is located behind the front panel of the vanity of the sink to receive the secondary field. Electronic circuitry including a microprocessor with software then processes the received signal to perform the desired functions.

It is noted that because electric fields can only penetrate nonconductive objects, the primary field cannot penetrate the human body and can penetrate the front panel of the vanity provided it is made of wood, plastic, or other nonconductive material. Once through the vanity, the electric signal is received by receiver antenna that may simply comprise a short wire or small metal plate that acts as an antenna to the field.

The proximity controller of the invention includes auxiliary additional control functions such as temperature control. These auxiliary control functions are selected by the person by means of additional transmitter antennas positioned relative to the sink, each including a separate excitation line from the controller. The controller may then selectively activate each excitation line with different signals or with the same signal that is multiplexed so as to sense which control function is being activated.

The additional or auxiliary transmitter antennas may comprise self-adhesive conductive foil patches that are adhered to the underside of the sink so that the electric field is emitted through the (presumed non-conductive) sink. Adhesive function labels are oppositely positioned in the inside of the sink in overlapping alignment with the respective conductive foil patches. These function labels are printed with the appropriate function to be selected (e.g., hotter or colder) such that when the person touches one of them, the auxiliary function is performed (e.g., the water is made hotter of colder).

Since it is extremely desirable to operate the sensor from a battery, or optionally a solar cell together with an electrical energy storage device such as a rechargeable battery or a large capacitor, it is important to reduce power consumption to an absolute minimum. In this regard it is noted that since little current is involved, the generation of an electric field requires little power. In the design of the sensor described herein it has been found sufficient to excite the spout with as little as one volt, although current versions employ 2.5 volts.

The proximity controller of the invention advantageously includes the following features. It responds only when at least one of the person's hands is near the spout thereby restricting water flow only to those times when a demand for water is clearly indicated by the person. It is insensitive to color variations of the person's hand or clothing. It requires only small amounts of power to operate, so as to permit operation under battery or solar power for long periods of time. It does not require the use of a specially constructed spout, but can instead be used with any ordinary spout, therefore making it easily retrofittable into an existing installation. It senses in an adaptive mode, thereby automatically compensating for changes in the environment near the sink without substantial changes in sensitivity and without causing prolonged unwanted water flow. It permits to the person to select auxiliary control functions such as water temperature, water flow rate, and prolonged flow of water to permit filling of buckets and the like.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIGS. 3A–3J are electrical diagrams of the wiring diagram, the preamplifier, the power supply, the amplifier and bandpass filter, the signal sampler, low-pass filter, D/A converter, and signal comparator, the phase compensator and sample pulse generator, the solenoid valve drivers and clamps, the solenoid current inflection detector, the clock and signal output gates and drivers, and the microcontroller, oscillator, options switches, low voltage detector, and audible alert of the invention;

FIGS. 3K-1 & 3K-2 are software flow diagrams of the computer program implemented by the microcontroller of the invention;

FIG. 4, FIGS. 4A-1, 4A-2 & 4A-3 are a schematic diagram and waveform diagrams, respectively, of the solenoid current inflection detector circuit of the sensor electronics.

Similar reference characters refer to similar parts throughout the several views of the drawings.

DETAILED DESCRIPTION OF THE PREFERRED EMBODIMENT

Figure 1:
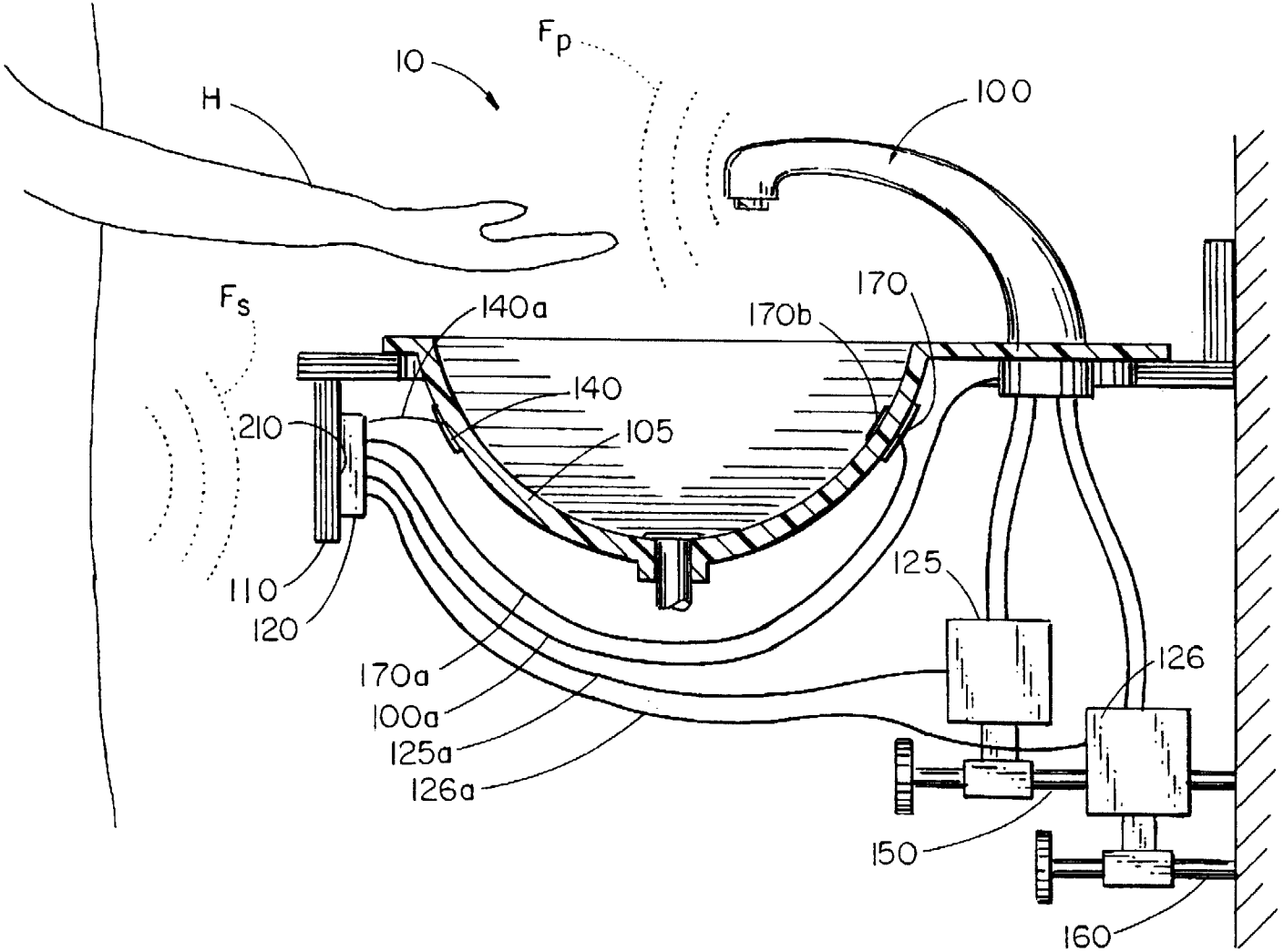
FIG. 1 is a cross-sectional view of a typical sink mounted within a vanity illustrating the proximity controller installed therein including sensor electronics, the shielded conductor to the spout, an auxiliary control touch pad and its shielded conductor, solenoid valves and their control wires, with a representation of the primary electric field lines being transmitted from the spout and the auxiliary control pad and the coupling of the primary field to the hand of a person and with a representation of the secondary electric field emanating from the body of the person to a receiver mounted on the front panel of the vanity.

FIG. 1 illustrates the proximity controller 10 of the invention installed in a typical residential sink 105. Spout 100 is connected via a shielded excitation wire 100*a* to the sensor electronics 200 which causes the spout 105 to emit a primary electric field $F_p$. The primary electric field $F_p$ is coupled through a person's hand H such that his or her body (not shown) emits a secondary electric field $F_s$. The secondary electric field $F_s$ is received by a receiver antenna 210 incorporated into the casing 120 of the sensor electronics 200 (see FIG. 2) and is then processed by the sensor electronics 120.

More particularly, spout 100 is connected to solenoid valves 125 and 126 which control hot and cold water respectively from supply conduits 150 and 160. The solenoid valves 125 and 126 are preferably made of plastic so as to provide electrical insulation between the spout 100 and the supply conduits 150 and 160 (which if made of metal would tend to ground out the excitation voltage on the spout 100). Also, solenoid valves 125 and 126 are preferably of the latching type so that power is not constantly required to open them. Such plastic latching valves are readily available from at least one commercial supplier.

The casing 120 containing the sensor electronics 200 is preferably located behind the front panel of the vanity 110. It is noted that the vanity 110 requires no through holes except as may be required for mounting the casing 120, or except as may be required if the vanity 110 is made of metal in order to allow the electric field to couple into the receiver antenna 210. A conductive shield 140, such as one fabricated from metal foil, may be adhered to the underside of sink 105 to provide a signal barrier between spout 100 and the receiver antenna 210. While this shield 140 enhances the sensitivity by blocking direct electric coupling from the spout 100 to the receiver antenna 210, it should be appreciated that this shield 140 is not required for satisfactory operation.

A plurality of auxiliary transmitter antennas 170 (one illustrated) are provided for auxiliary control functions. The transmitter antennas 170 are made by adhering metal foil to the underside of the sink 105 over a small surface area. Respective excitation wires 170*a* provide the excitation voltage from the sensor electronics 200 to the transmitter antenna 170, with each excitation voltage being in some manner different from that supplied to spout 100 so as to permit discrimination by the sensor electronics 200. This difference may be in terms of temporal spacing or in terms of frequency of excitation. Touch pad labels 170*b* (one illustrated) mark the touch area for the person's convenience and also label the specific function.

Figure 2:
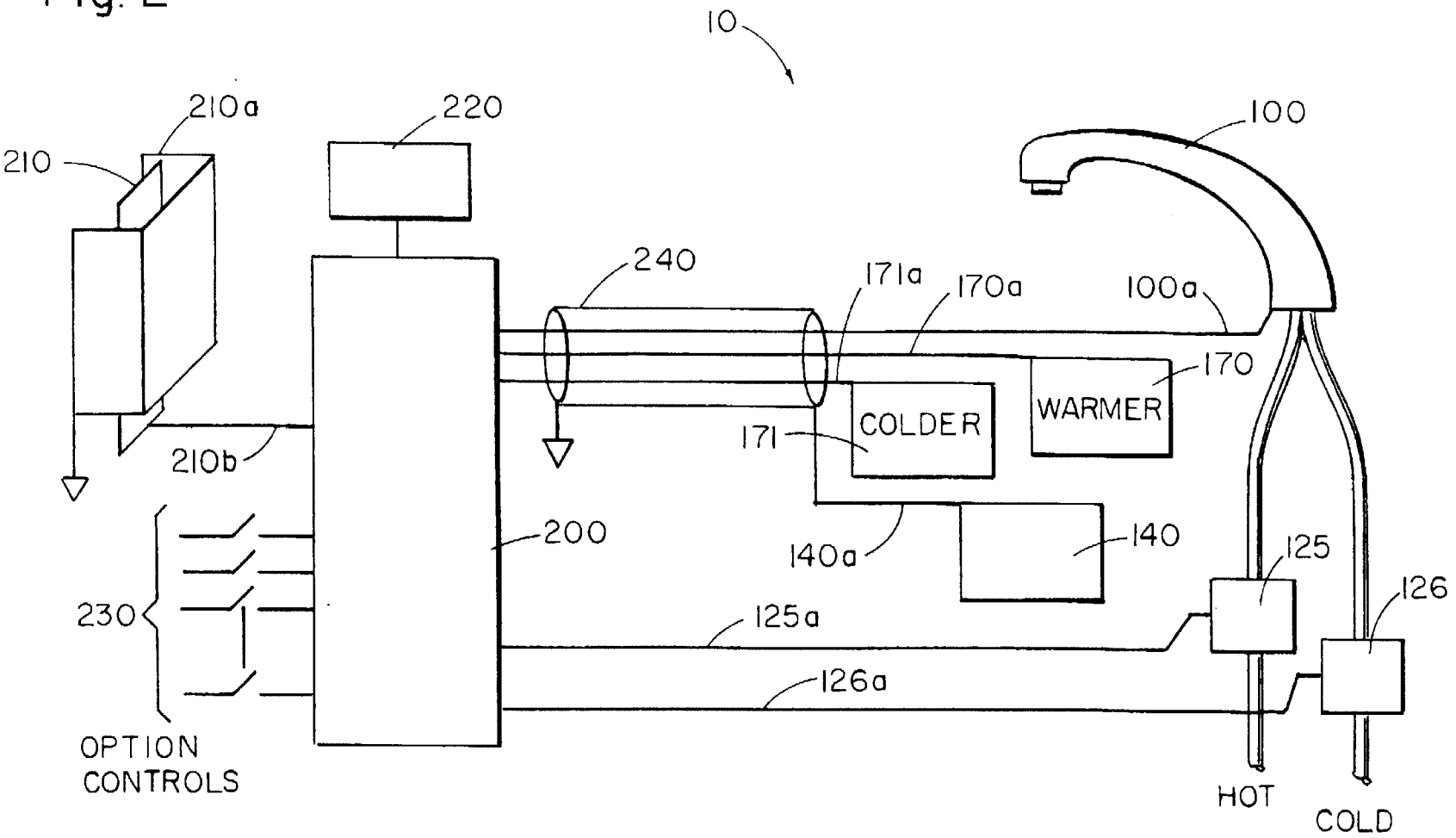
FIG. 2 is a block diagram the sensor electronics of FIG. 1 and the associated conductors to the spout, solenoid valves, auxiliary touch pads, battery, receiver antenna and option switches.

FIG. 2 illustrates one embodiment of the invention in block diagram form. Sensor electronics 200 provides all the required processing and control functions, and is detailed further herein. Excitation conductors 100*a*, 170*a*, and 171*a* are covered by a shield 240 to prevent leakage of electric field $F_p$ from the conductors since such leakage would otherwise tend to make the sensing of the field less controlled than is desirable.

A metallic conductor preferably forms the receiver antenna 210 that detects the secondary electric field $F_s$ coupled from the person's hand H through the vanity 110. The receiver antenna 210 is preferably partially enclosed in a conductive shield 210*a* so that it is more sensitive in the frontal direction toward the person's body than towards the spout 100. It is noted that the receiver antenna 210 may be enclosed together with the sensor electronics 200 in casing 120, with the casing 120 being made of metal and shaped so that the metal does not cover the receiver antenna 210 in the frontal direction.

Control switches 230 preferably in the form of dip switches, provide installer controls which allow for the selection of various operating modes or options as described hereinafter.

In the configuration shown in FIG. 2, only two valves 125 and 126 are provided, one for hot and another for cold water. When both valves 125 and 126 are on, warm water is supplied to the spout 100, with touch control pads 170 and 171 being appropriately touched by the person's hand H to obtain hot or cold water flow as desired. It can be appreciated that in many instances a source of warm, tempered water is already available, in which case satisfactory operation may be obtained with only one valve and no touch control pads. In other cases even more control is desired and the valving system can become more sophisticated as described hereinafter in connection with FIG. 2A.

Figure 2A:
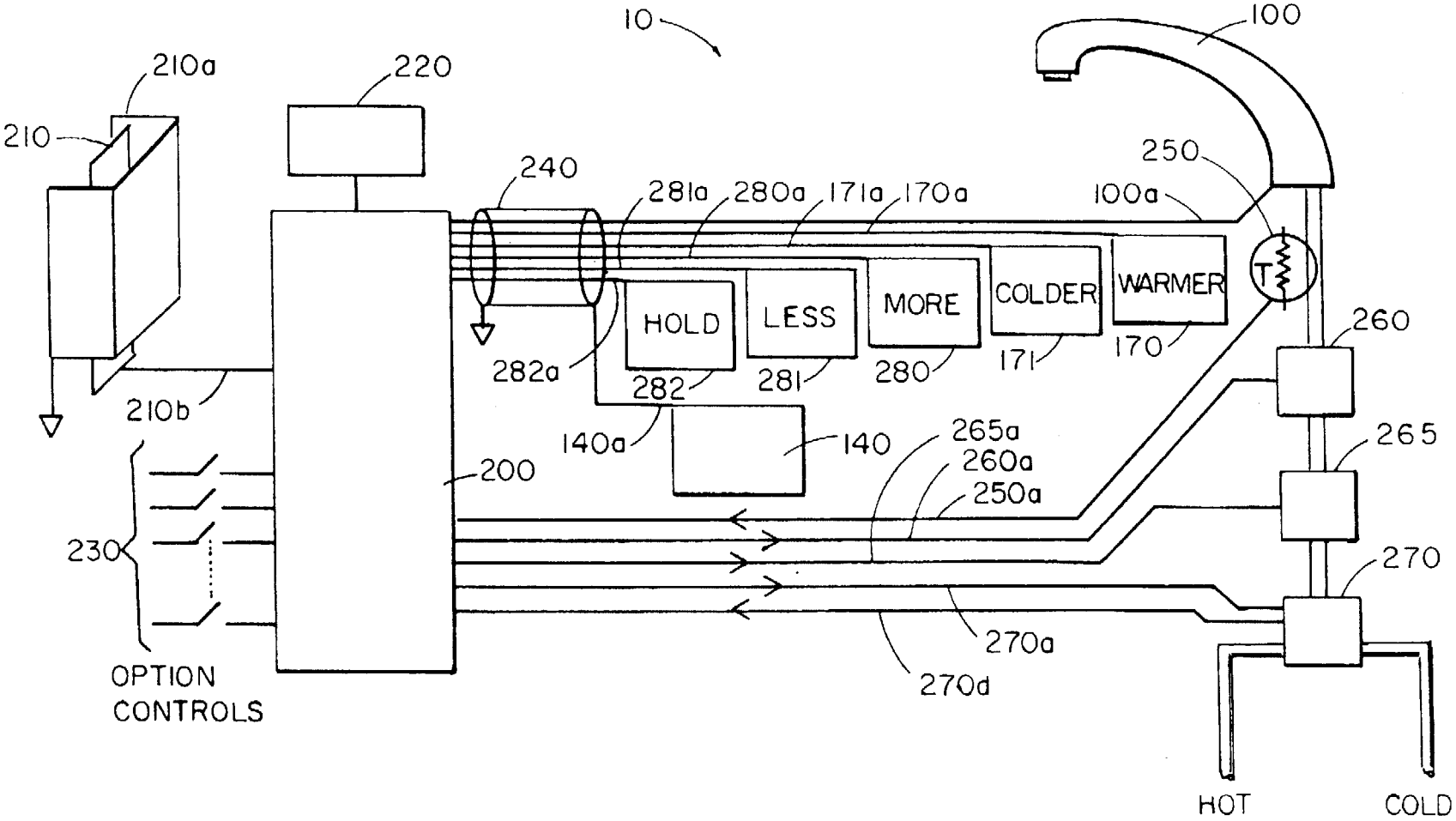
FIG. 2A is a block diagram of the sensor electronics similar to that of FIG. 1, but including additional auxiliary touch control pads, temperature sensor and, in lieu of separate solenoid valves for hot and cold operation, a single solenoid on/off valve, a flow rate valve and a mixing valve.

In FIG. 2A is shown the same basic proximity controller 10 as in FIG. 2, except that three more touch control pads 280, 281, 282 have been added, and the water valving has become more sophisticated. Specifically, a flow control valve 265 permits control over water flow rate. Variable mixing valve 270 allows fine control over water temperature. On/off valve 260 allows complete shutoff of water flow, and is preferably of the magnetic latching type. Valves 260, 265 and 270 are electrically connected to the sensor electronics 200 via conductors 260*a*, 265*a*, and 270*a* and are controlled thereby.

Additional touch control pads 280 and 281 permit user control of the flow control valve. Touch control pad 282 permits convenient water flow hold control, whereby water flow is "locked on" for a period of time regardless of further detections by sensor 200, which may be released to resume normal operation by touching it a second time.

A temperature sensing element 250, typically a thermistor, is positioned in thermal contact with the water flow to the spout 100 and is electrically connected to the sensor electronics 200 via conductor 250*a*. The temperature sensing element 250 senses water temperature flowing to the spout 100 and sensor electronics 200 can use data from the temperature sensing element 250 to determine whether a scald condition exists, and if so, shut off water flow. The temperature sensing element 250 may also be used to control water temperature to maintain a given spout temperature even as inlet temperatures to mixing valve 270 changes over time.

Figure 3:
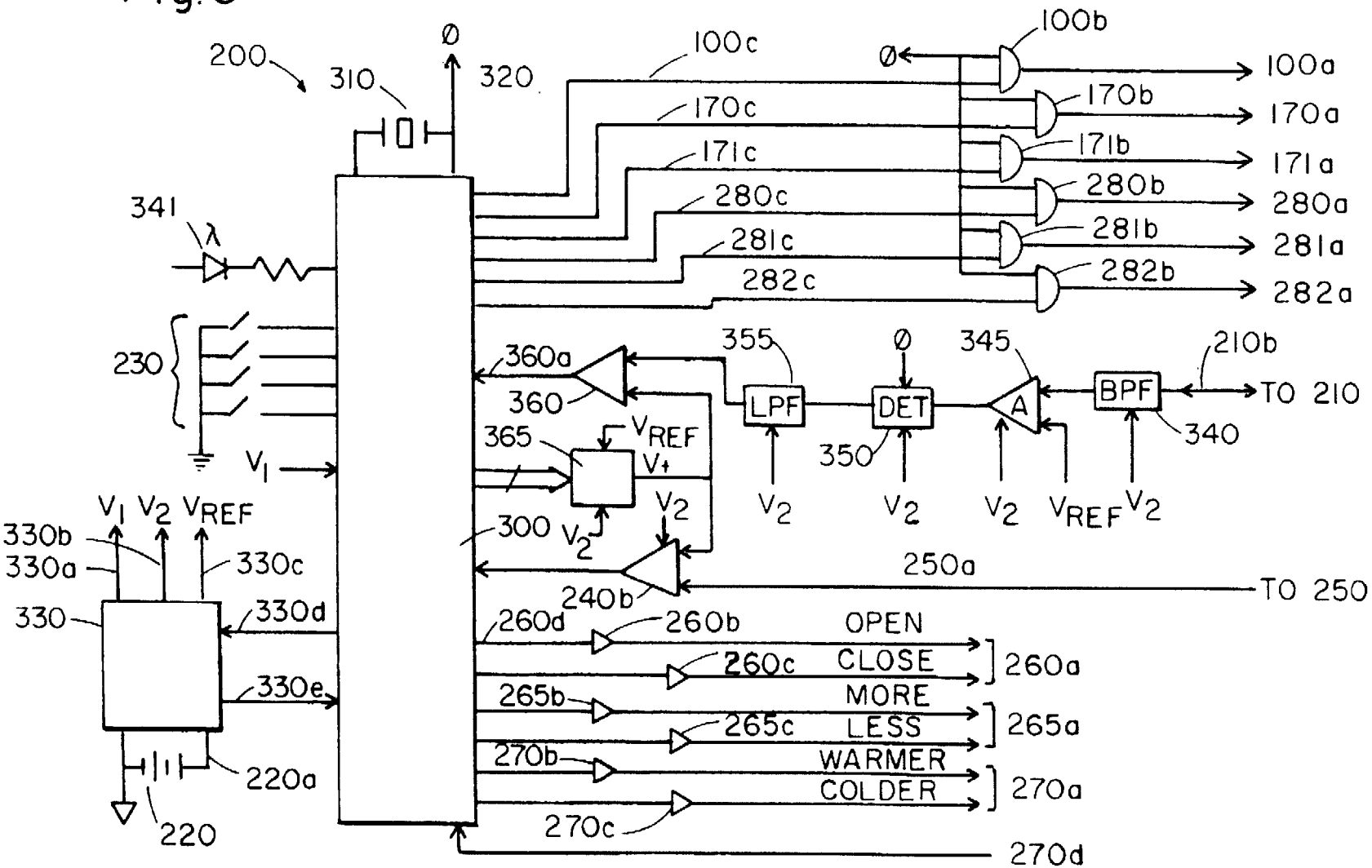
FIG. 3 is a block diagram of the sensor electronics including a microcomputer and associated analog and digital components.

FIG. 3 shows a block diagram of the preferred embodiment of the sensor electronics 200 of FIG. 2A. While a microprocessor based version is shown, it can be appreciated that an equivalent functionality can be readily produced using standard digital and analog integrated circuits and discrete components, and/or with the use of one or more custom LSI (large scale integration) integrated circuits.

In FIG. 3, microcontroller 300 is provided which includes at least program ROM containing an appropriate control program, data RAM, and I/O ports for controlling the remainder of the hardware. Crystal 310 operates the circuit at a convenient frequency of operation, for example 32,768 Hz, which is a frequency commonly employed in digital watches. While clock signal 320 is shown to also be driving the excitation lines 100*a*, 170*a*, and 171*a* via excitation gates 100*b*, 170*b*, and 171*b*, respectively, it may be appreciated that separate oscillation sources and/or digital dividers may be used when convenient to do so. The excitation gates 100*b*, 170*b*, and 171*b* are controlled by software resident in the microcontroller 300 in such a manner as to allow one or more of them to pass the clock 320 to an excitation line, so that a proximity or touch response may be ascertained as coming from a particular excitation field corresponding to a particular function. The electric field signal is ultimately received by receiver antenna 210, which feeds into bandpass filter (BPF) 340. BPF 340 preferentially passes signals at or near the signal frequency of the excitation field. The received signal is amplified by an amplifier 345, and is then detected by a synchronous amplitude detector 350. Note that the BPF 340 and the amplifier 345 can be readily combined into one circuit using conventional circuit design techniques. The output of detector 350 is a time-varying DC signal whose amplitude varies with the amount of excitation coupling into the receiver antenna 210, as well as coupling from noise sources including self-generated circuit noise. This signal is then passed through low-pass filter (LPF) 355 to smooth the resulting signal, and then on to comparator 360 which compares the signal with a comparison level generated by digital-to-analog convertor (D/A) 365 whose analog output is programmed by microcontroller 300. The resulting output of the comparator 360 is sampled periodically by the microcontroller 300 to determine if a valid detection has occurred. When a detection has been ascertained, microcontroller 300 commonly causes the proper driver to one of the solenoids 260 and 265 or the variable mixing valve 270 to energize. Following a brief period after the cessation of any detection, microcontroller 300 commonly causes the water flow to cease by closing the solenoid valve 260. As mentioned earlier, a response from pad 282 would cause water flow to be held on for a period of time.

The coils of the water solenoid valves 260 and 265 and the variable mixing valve 270 are driven by drivers shown as 260*b*, 260*c*, 265*b*, 265*c*, 270*b*, and 270*c*, respectively. Drivers 260*b*, 260*c*, 265*b*, and 265*c* may comprise NPN darlington transistors with diode clamps to absorb the inductive kick generated by the coil or motor windings. While 3-wire solenoids of the latching type are shown, in practice 2-wire solenoids, also of the latching type, may be used in conjunction with H-bridge switches which allow the current to be reversed for shutoff. Drivers 270*b* and 270*c* are H-bridge drivers to permit the motor in the mixing valve 270 to be reversed. Line 270*d* is the motor feedback line or lines which indicate variable mixing valve position for the benefit of a control algorithm contained in microcontroller 300.

Power supply 330 supplies regulated power derived from power source 220 to the microcontroller 300 and other analog and digital elements. In particular, voltage $V_1$ supplies a steady voltage, preferably 2.5 volts, to microcontroller 300 and control gates 100*b*, 170*b*, and 171*b*. A second supply output $V_2$ 330*b* supplies voltage, preferably 5 volts, to the remaining analog elements. This 5 volt voltage has the unique ability to be switched on or off under control of microcontroller 300 via control line 330*d*. This feature allows microcontroller 300 to reduce power consumption between its samples of the comparator 360 by simply shutting the remaining circuitry off while unused. Voltage $V_{ref}$, preferably 2.5 volts, is switched similarly to $V_2$, but is a special reference voltage used only by D/A 365 and the amplifier 345. This voltage is essentially an artificial ground.

The voltage regulators employed for $V_1$ and $V_2$ may be three-terminal types having low quiescent current draw. Such regulator ICs, fashioned with CMOS technology, are available from a number of sources. The voltage regulator for $V_{ref}$ may be of the precision shunt type, also commonly available. Power supply 330 also outputs signal 330*e* to microcontroller 300, which is used to indicate the state of the supply voltage. If supply voltage drops to a marginal level, output signal 330*e* would activate causing microcontroller 300 to take an appropriate action, such as shutting off water and inhibiting further usage.

The above elements cited in FIG. 3 are all common to the art of electronic design and should require no further clarification to those skilled in the art. However, FIGS. 3A–3J described in detail hereinafter illustrate the most preferred circuit diagrams of the sensor electronics 200 and FIGS. 3K-1 & 3K-2 are program flow diagrams corresponding thereto.

In general, microcontroller 300 operates by periodically performing the following functions in sequence:

1. Turn on analog power 330*b* and 330*c* via control line 330*d*;
2. Gate on excitation voltage 100*a* to the spout 100 by means of control line 100*c*;
3. Set D/A 365 to a detection comparison level $V_r$;
4. Wait a brief period of time to allow the analog circuitry to settle following power-up;
5. Sample line 360*a* for a response;
6. Turn off analog power via line 330*d*.
7. Enter "sleep" mode.

The above sequence assumes that no detection is observed during step 5. The sequence is repeated at a fairly low rate to conserve power, typically every 0.25 to 0.5 seconds. In the interim, the microcontroller 300 may "sleep" in a special stop mode as may be provided by the manufacturer of the microcontroller, to be reawakened following a fixed delay generated by the microcontroller's internal timer (step 7). As one skilled in the art may appreciate, while it is feasible to do a complete A/D conversion of the signal level on each cycle, to do so requires more time and hence more power dissipation. In the interest of saving power, particularly from a battery or solar cell, the above method has been devised to test the signal against a known threshold. This threshold may need to drift over time to compensate for environmental and circuit changes. Thus, every 'n' number of cycles (typically, 'n'=10), the microcontroller 300 performs the following functions between steps 5 and 6 listed above, provided no detection was observed during step 5:

5a. Set D/A 365 to a stored reference level voltage $V_r$ believed to be close to the background signal level;

5b. Wait a brief period of time for the D/A 365 and comparator 360 to settle;

5c. Sample line 360*a* for a response;

5d. If the compared signal is higher than $V_r$, increase $V_r$ and $V_t$ by 1 bit; if lower than $V_r$, decrease $V_r$ and $V_t$ by 1 bit; Save $V_r$ and $V_t$ in memory;

5e. Go to step 6.

This sequence allows the microcontroller to track the background level slowly (+/−1 bit count every 'n' intervals) to compensate for long term circuit drift and any environmental fluctuations. The numerical difference between $V_t$ and $V_r$ corresponds to the increase in the amount of signal required to actuate the sensor. $V_t$–$V_r$ may be determined via switches 230 as a user sensitivity setting, or may simply be fixed. Alternatively, $V_t$–$V_r$ may be automatically computed by an algorithm that attempts to set the most sensitive setting possible for a given background noise signal level.

If a detection is found in step 5, the microcontroller performs the following sequence following step 6 to actuate a latching magnetic solenoid valve 260:

6a. Turn on driver 260*b* to turn on water flow;

6b. Delay a duration Ts to allow solenoid to change state;

6c. Turn off driver 260*b*.

When a detection is no longer sensed, the microcontroller shuts off water flow using the above steps but with driver 260*c* instead of 260*b*. Duration $T_s$ is a period of time, typically 10 milliseconds, which is necessary to make the latching solenoid change state.

Figure 4:
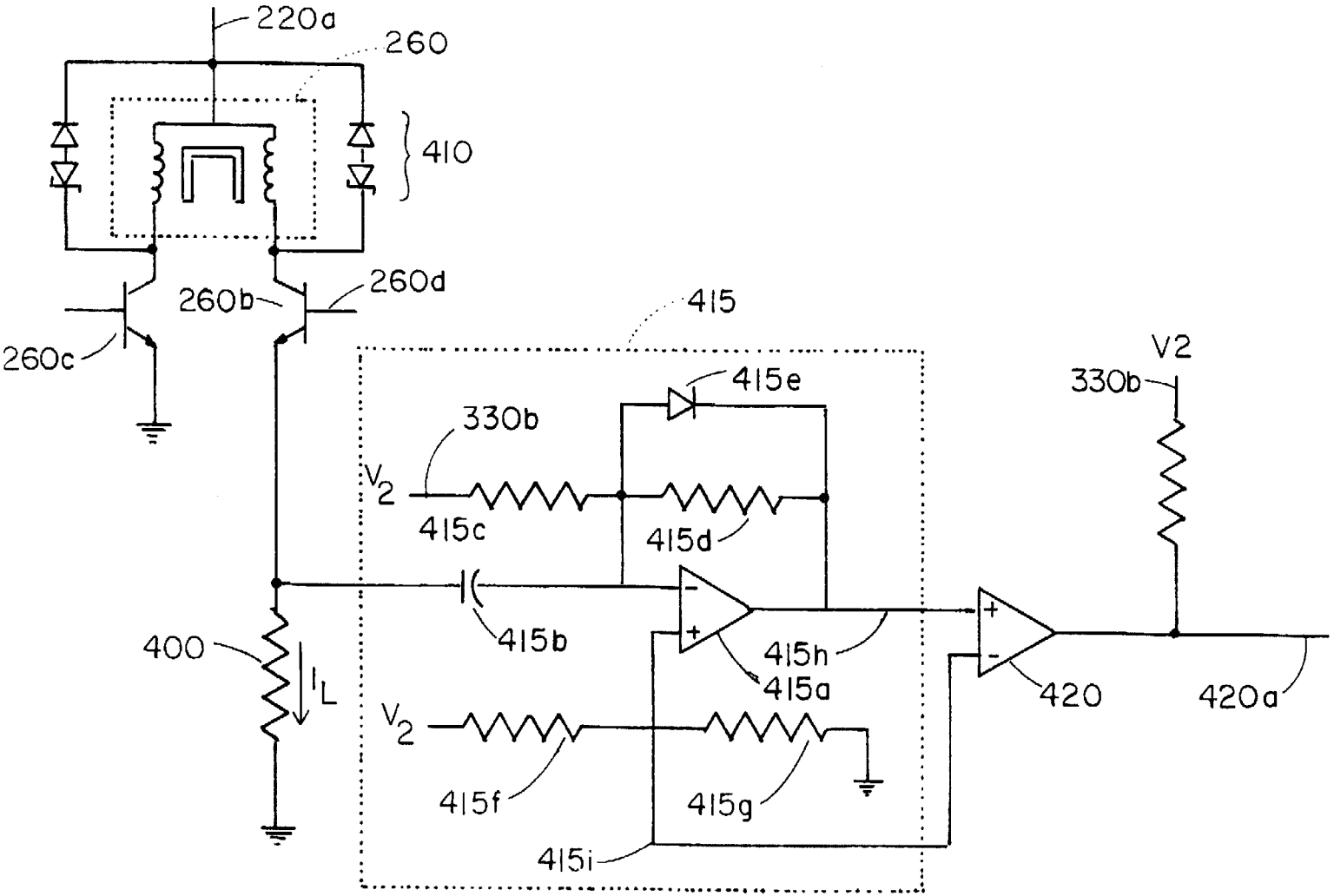
Figures 1, 2, 3, 4A:
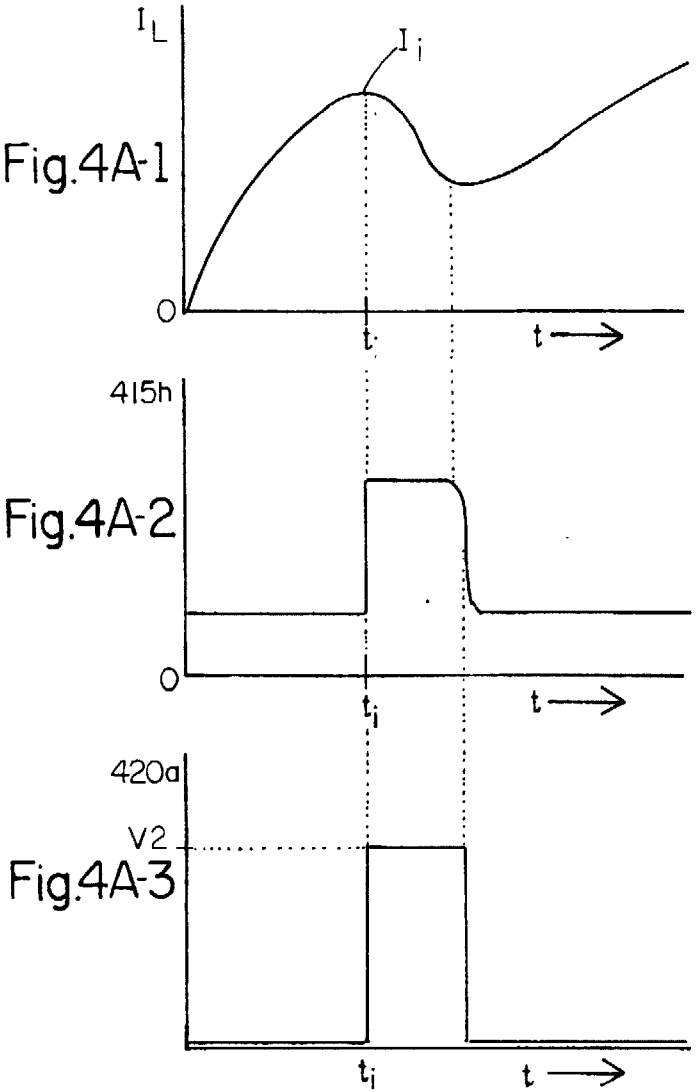

As an enhancement to the control of current through a latching solenoid by way of additional circuitry shown in FIG. 4, the duration of current actually required to actuate the latching solenoid valve can be carefully optimized so as to reduce power consumption to an absolute minimum. As revealed in U.S. Pat. No. 4,742,583, the disclosure of which is incorporated herein, the current flow through a magnetic solenoid makes a brief reversal of direction, that is, the first derivative of the current reverses whenever the solenoid plunger begins to draw in. This effect is due to the change in inductance of the solenoid, and the transfer of stored energy in the coil to the plunger as it accelerates inward. By means of the additional circuitry shown in FIG. 4, it is possible to detect this point of inflection labeled $I_i$ in FIG. 4A-1. Resistor 400 develops a voltage proportional to solenoid coil current upon the actuation of transistor 260*b* by microcontroller 300 via control line 260*d*. Circuit 415 acts as a differentiator, with clamp diode 415*e* acting to speed the detection of the point of inflection $I_i$ by preventing operational amplifier 415*a* from saturating to negative. Because the resulting output shown in FIG. 4A-2 does not reach zero volts and thus is not necessarily a valid logic level, a comparator 420 is used to convert the levels of FIG. 4A-2 to a valid logic signal shown in FIG. 4A-3. Line 420*a* thus indicates the point of inflection, and is used to signal microcontroller 300 to turn off control line 405*a*. Diodes 410 are used to safely clamp the inductive kick following release of transistor 260*b*. The steps replacing 6a, 6b and 6c above to perform this function in software are as follows:

6a. Turn on transistor driver 260*b*;

6b. Begin a limit timing function of duration $T_{max}$;

6c. Wait until either $T_{max}$ expires or a signal is sensed on line 420*a*, whichever occurs first;

6d. Turn off transistor driver 260*b*.

The use of timer duration $T_{max}$ is necessary in case solenoid 400 does not change state for any reason, such as if battery power is too low to properly drive the solenoid.

It should be noted that the circuit comprising 400, 415, and 420 may be shared among a multiple number of latching type actuators, providing only that no more than one such actuator is used at a time. Additional transistors such as 260*b* are used for each actuator, while the microcontroller 300 senses the single line 420*a* for all actuators. Also, the circuit of FIG. 4 may be powered down between uses so as to conserve power. Transistor 260*c* shown in FIG. 4 is used to shut off flow; this side of the solenoid does not typically benefit greatly from an inflection detecting means, since the current duration required to shut a latching solenoid valve off is usually quite short and repeatable.

Auxiliary control pads are sensed by microcontroller 300 in a similar sequence to steps 1 through 7 above. This is conveniently performed only while water is actually flowing. The sequences are basically the same, except that during each test of a control pad one of lines 170*c*, 171*c*, 280*c*, 281*c*, or 282*c* are set to gate on the proper excitation drive. In the case of temperature control, touching a temperature control pad results in a change in position of the variable mixing valve 270. In the case of flow control, solenoid 265 changes state.

Special control modes may be entered into by means of the use of combinations of control lines. For example, touch control pads 170 and 171 (i.e., "warmer" and "colder") when touched simultaneously may force the sensor into the "hold" mode, thus eliminating the need for a separate touch pad 282. Touching both pads simultaneously again releases this mode and shuts off water flow. Other combinations might force the controller 10 to enter a diagnostic mode, or allow installer setup of various parameters that might otherwise be set by switches 230 such as sensitivity, delay times, etc.

Figure 5:
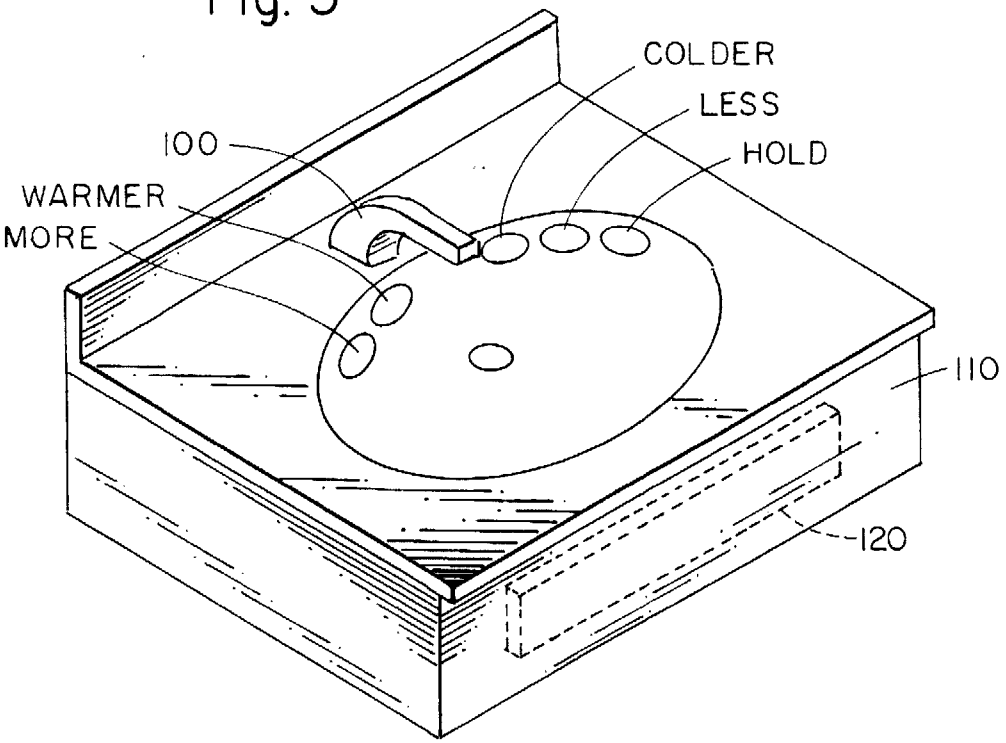
FIG. 5 illustrates the positioning of the auxiliary touch pads in the upper rim of the sink and their preferred associated control functions.

In practice, any number of auxiliary control lines and touch control pads may be used to provide functionality as desired, limited only by hardware considerations and a reasonable amount of space to place them inside (or next to) a sink. In FIG. 5 is shown the inside of a sink 105 having the five different touch control pads for warmer/colder temperature control, more/less flow rate, and water hold as described for FIG. 2A. Such a configuration might prove most useful in a home, where maximum flexibility is desired. For institutional or commercial use, a proximity controller 10 with only temperature controls or no touch controls at all may prove most useful. Another possible touch pad control function could be water shut-off, which in combination with touching the spout 100 or another pad to turn water on, provides a different modality of operation that may be considered semiautomatic. Not shown in FIG. 5 but potentially desirable might be the addition of numerical or graphic display means for indicating faucet state, such as an LCD display to indicate temperature, etc. Also possible is an audible transducer which can provide positive feedback for user touches of the controls.

The software, aside from the detection and self-calibration algorithms described previously, must also perform other functions to provide for satisfactory operation. In the following descriptions it should be appreciated that it is always possible to implement these functions purely in hardware, either in random logic or perhaps with a state machine, and that any such implementation is within the scope and spirit of the invention.

One such function is calibration. During startup, and sometimes during normal operation, the proximity controller 10 must calibrate itself so that it can determine the initial values of $V_r$ and $V_r$. It does so by successively approximating the signal level through the use of comparator 360 and D/A 365. It may also do it if, for a prolonged interval, the controller 10 does not sense a zero crossing during step 5c noted above; if this occurs, the sensor's background signal level may have shifted dramatically and require a complete recalibration rather than a slow incremental adjustment as provided in steps 5a–5d.

Another function is off-delay timing. The sensor should maintain water flow for a minimum duration of time beyond the moment of last detection, so as to prevent rapid water cycling should a person's hands be near the detectability limit of the sense field or should a person rapidly withdraw and then reinsert his or her hands into the field. It has been found that a rapid shutoff of water is extremely annoying, and in any case causes many more solenoid actuations to occur over time. This causes premature solenoid wear, and also will drain a battery power supply sooner.

Yet another function is on-limit timing. If an object is placed or tossed into the sink 105 in such a manner as to trigger the controller 10, such as a wet towel, the software should eventually cause a timeout and shut off the water flow. While this feature is common among optical proximity controllers, it is not the most desirable method of solving the problem. A better solution devised for the controller 10 of this invention is to force the controller 10 to recalibrate itself after the timeout, thus permitting the controller 10 to remain fully functional after the timeout while also shutting off the water flow.

A further function is a setup mode, whereby the software permits the installer to change various options. This can involve nothing more than reading switches 230 and taking appropriate actions. It can also involve the use of combinations of touch control pads to set different modes or operating parameters. Some of the items which may be altered by either method include:

1. Default water temperature setting on first detection;
2. Plumbing configuration: single or dual water line feeds;
3. Off-delay timing duration;
4. On-limit timing duration;
5. Sensitivity to hand proximity to spout;
6. Sensitivity to auxiliary control pads.

Software can also provide a calibration capability in the event that the hardware requires a calibration potentiometer to adjust (for example) signal offset. LED 341 can greatly facilitate any such calibration procedure.

A further possible software function is diagnostics, whereby the software checks the microcontroller and as much peripheral hardware as it can, and returns a diagnostic signal to the installer by flashing LED 341.

More particularly, FIGS. 3K-1 and 3K-2 are flow diagrams of a preferred embodiment of the program control that is stored in the ROM of the microcontroller 300. The program flow is self-evident to one skilled in the art, such as a computer programmer, once the program variables used therein are defined as follows and then the program flow is compared in relation to FIGS. 3A–3J described below:

DIP switch 230 settings as set by the installer define the following presettable variables in the computer program:

1. DELTA1 (sensitivity to first approach to spout or a touch pad);
2. DELTA2 (sensitivity to subsequent touches or proximity to a touch pad);
3. State B14 (which combination of valves comes on upon first approach to spout or touch pad);
4. Extend_limit (amount of time water flow is extended past last detection of a presence); and
5. Max_on_limit (maximum duration of permitted water flow prior to forced halt and recalibration).

The computer program obtains the following variables:

REF1: the primary detection reference level, obtained via a successive approximation (SA) of the incoming signal while the spout and both pads are driven with signal. This happens (the SA) only during a complete recalibration. Normally, REF1 changes by only one LSB count, either + or –, to drift slowly to compensate for local changes in signal due to thermal drift, moisture buildup on surfaces, long term circuit aging, etc. The counter MIAN_LOOP is used to determine when to do the +/– drift check testing. REF1 is the signal detected when there is no human presence near the sink.

REF2: the pads detection reference level, used in exactly the same way as REF1, except this level corresponds to the signal when only one of the pads is driven with a signal. This is used to compute a threshold value when pad touch detection is desired, to determine which pad(s) are being touched (or proximity to). Like REF1, REF2 normally changes by only +/–1LSB periodically to compensate for slow environmental drift. REF2 is the base signal level from one pad only with no human proximity. Because the pads are systematically attached to the sink surface, there is normally no need to generate a separate reference for each pad. If non-symmetrical attachment is used, where the base level signals from each pad are radically different, then a third reference, REF3, would be required; REF2 would be used for the WARMER pad, and REF3 for the COLDER pad. The control flow would be essentially identical to that shown.

DELTA1: This is the sensitivity factor to initial approach to the spout or pads. DELTA1 is added to REF1 to generate THRESH1. THRESH1 represents the threshold D/A level applied to cap C6 during normal operation when the unit is quiescent, i.e. waiting for a person to approach. With THRESH1 applied, U1:A will generate a compare output (see COMPOUT signal on schematic of FIG. 3E described below) if the sampled signal exceeds this level. DELTA1 value is determined by the DIP switch setting to allow the user to change sensitivity to initial approach.

DELTA2: Same as DELTA1, except this is used for determining the sensitivity to pad proximity or touch; when added to REF2 it creates THRESH2. DELTA2 is also alterable via the DIP switch to allow sensitivity adjustment to the pads when changing water mix.

THRESH1, THRESH2: These parameters are used to set the D/A capacitor C6 with the proper comparison voltage level to determine if the received signal is large enough to qualify as a detection. U1:A makes this comparison and generates the COMPOUT signal.

MAIN_LOOP: This is the "main" looping control variable used to determine when to refresh capacitor C6 with THRESH1 level. MAIN_LOOP always starts at 0; When MAIN_LOOP exceeds MAIN_ENDCOUNT, the C6 voltage is regenerated. This is required periodically to prevent excessive drift of voltage on capacitor C6 due to leakage currents. This refresh typically occurs every 10 seconds.

DRIFT_LOOP: This timing variable is used to determine when to do a "drift check", by placing first voltage REF1 and then voltage REF2 onto capacitor C6, and observing COMPOUT for polarity of detection. If the signal is observed to be higher than the reference level, the reference level is increased by 1 LSB. If the signal is lower, then the REF is lowered. This is done first for REF1 using first the pads and spout driving signals together, and then for REF2 using just one pad signal (either warmer or colder pad will do). If a third REF level is required so that each pad has its own REF level, then obviously a third test must be performed. DRIFT_LOOP causes the "drift" checks to occur when it exceeds DRIFT_ENDCOUNT value. A typical DRIFT_LOOP cycle occurs every 5 seconds. ON_EXTEND is used to extend the time duration that water will flow after hands are removed the detection field. This effect prevents water from shutting off too fast; if there were no such extension, water flow would appear erratic as one's hands momentarily left and reentered the detection zone rapidly; a rapid shutoff is considered annoying by most poeple. This parameter can be altered via the DIP switch setting. A typical extension interval might be 2 seconds.

MAX_ON is used to prevent water flow from lasting more than a certain duration, for example, one minute. After that duration, water flow is forcibly shut off regardless of signal strength. This prevents improper, lengthy operation under adverse sensing conditions, such as when a towel is thrown over the spout creating a large enough signal to actuate the water flow. When the max duration has timed out, the unit shuts off the solenoid valves and does a complete recalibration and then tries to resume normal operation. This parameter can be altered via the DIP switch setting.

It is noted that special states are provided for during the program flow as follows:

STATE A19 provides for a "flow hold" mode whereby if both touch pads are sensed simultaneously, the water flow will be made continuous for a certain duration, with the same valves being held open as before the mode was entered. This allows a sink or or a pot to be filled with water, unattended, without the danger of overflow. If both pads are sensed together during STATE A19, this state exits to allow normal operation. This exit permits user override of the fixed time duration. The time duration is alterable via the DIP switches.

STATES B6 and B21 employ the WAIT instruction of the microcontroller 300.

Finally, it is noted that the timer portion of the program flow is used to provide the following functions:

Create a "dead time" between samples of signal so that the device will consume less power. This is accomplished via the microcontroller's 300 WAIT instruction and an IRQ' generated by the internal timer module.

Time the D/A ramp to generate an analog comparison signal on capacitor C6 (upper left corner of schematic). This is used to compare the sampled (via switch Q2, cap C5) signal with the reference level of the D/A. By repeatedly generating C6 voltage ramps of amplitudes that follow a successive approximation algorithm, the circuit converts the incoming signal amplitude (from the preamp) to digital form. This process IS NOT done every cycle: only during calibration periods. At other times, only a single ramp on C6 is used to generate a comparison via U1:A to determine if the signal has exceeded the threshold level (THRESH1, THRESH2).

Figure 3A:
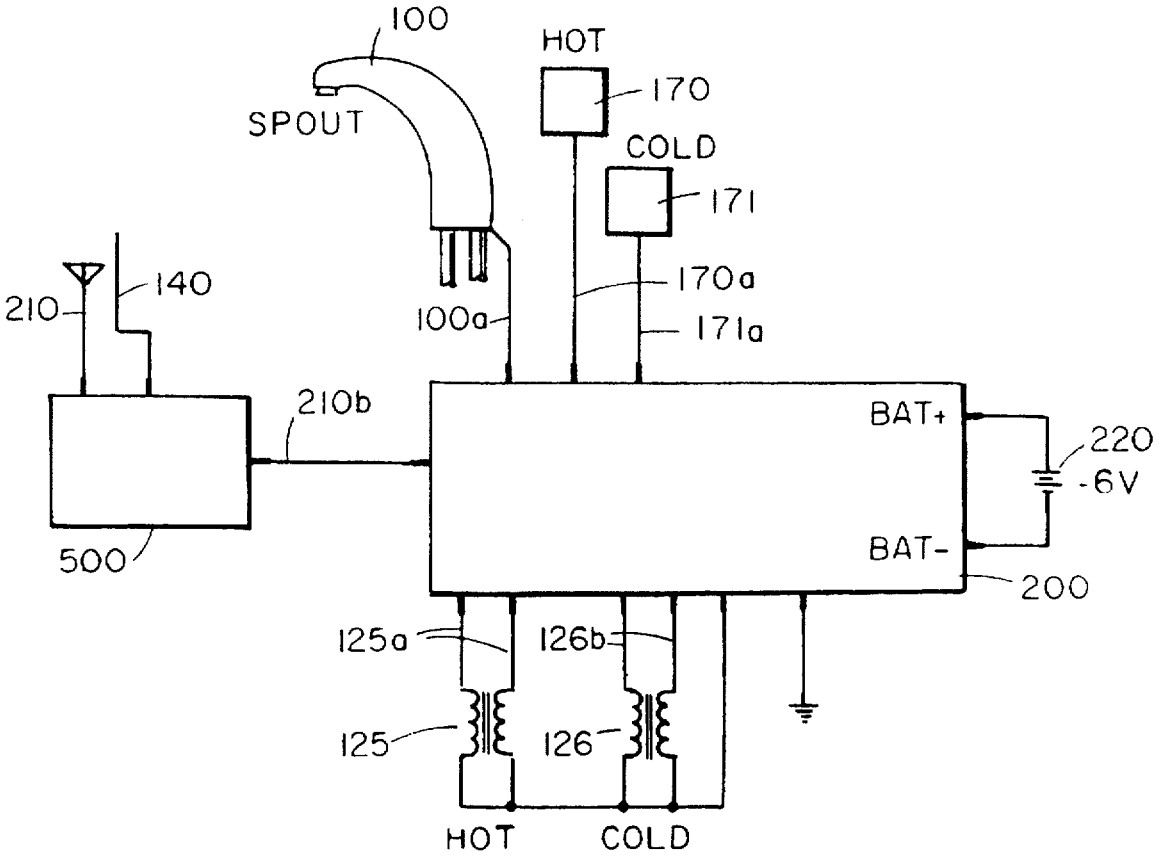

As noted above, the most preferred computer program of the microcontroller 300 is intended to operate in conjunction with the sensor electronics 200 that are illustrated in FIGS. 3A–3J. More particularly, FIG. 3A is a wiring diagram of the sensor electronics 200 in which the spout 100, hot touch control pad 170, and cold touch control pad 171 are connected to the sensor electronics 200 via conductors 100*a*, 170*a* and 171*a*, respectively. The hot and cold solenoid valves 125 and 126 are also connected to the sensor electronics 200 via conductors 125*a* and 125*b*, respectively. Supply voltage to the sensor electronics 200 is supplied by battery 220, preferably a six volt battery.

As noted above, the receiver antenna 210 is optimally positioned at the front of the sink 105 behind the front panel of the vanity 110, with a shield 140 positioned between it and the spout 100. However, it has been found that the sensor electronics 200 are more conveniently positioned at the rear of the vanity 110. Hence, it has been found to be necessary to provide a preamplifier 500 at the receiver antenna 210 in order to amplify the received signal from receiver antenna 210 which is then supplied to the sensor electronics 200 via shielded cable 210*b*.

Figure 3B:
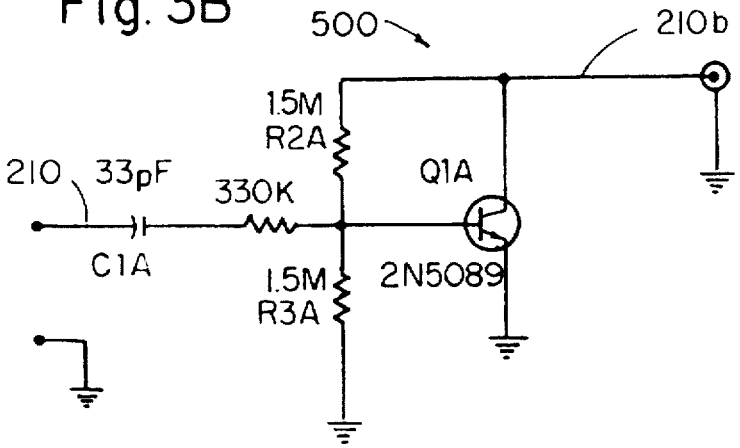

FIG. 3B is a schematic diagram of the common emitter preamplifier 500 that comprises NPN transistor Q1A and bias resistors R2A and R3A, coupling capacitor C1A (to eliminate DC offsets), electric discharge resistor R1A (to reduce electric voltage that may occur during installation), and connectors for the receiver antenna 210 and the shielded cable 210*b*.

Figure 3C:
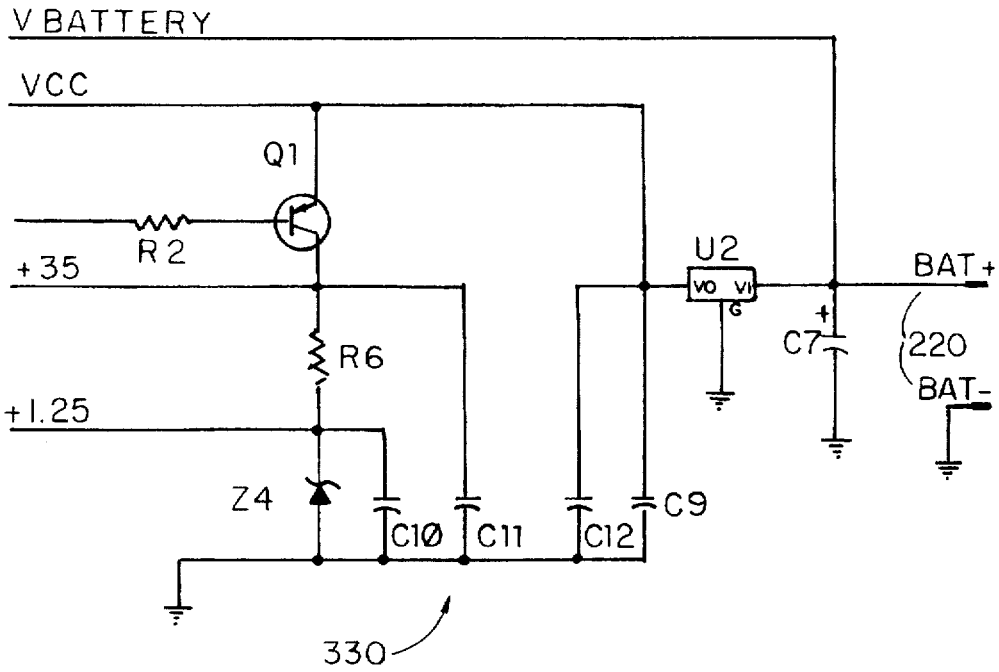

FIG. 3C is a schematic diagram of the power supply 330 of the sensor electronics 200 including battery connection to capacitor C7 that lower the effective impedance of the battery 220. Voltage regulator U2 provides supply voltage $V_{cc}$ (3 volts). Bypass capacitors C9 and C12 are provided to quiet the supply voltage $V_{cc}$. Switch transistor Q1 operates as a switch to provide for two switchable supply voltages (+3S and +1.25 volts) and is controlled by gate supply via resistor R2 from the microcontroller 300. Resistor R6 supplies voltage to zenor diode Z4 that sets the +1.25 supply voltage. Capacitors C10 and C11 provide bypass to the supply voltages.

Figure 3D:
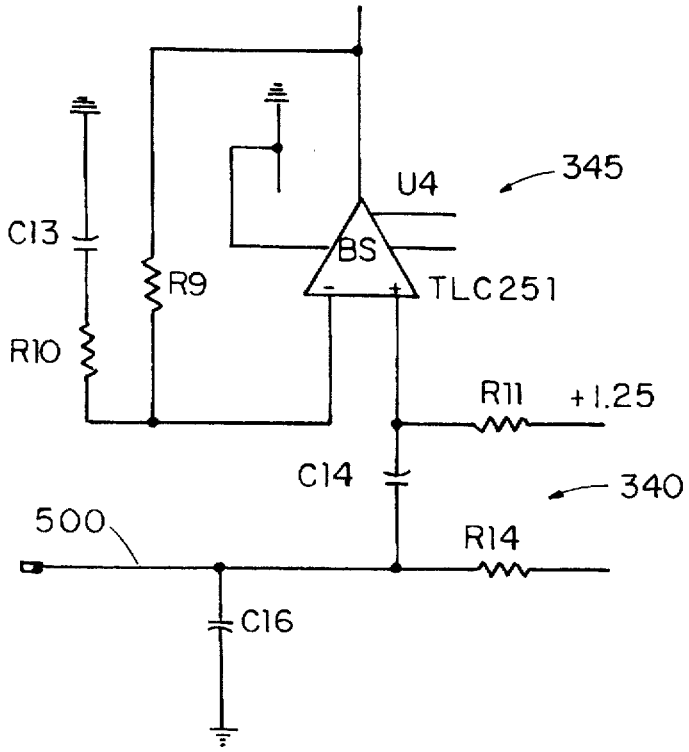

FIG. 3D is a schematic diagram of the BPF and amplifier 340 and 345 of the sensor electronics 200. The input to the BPF 340 from the preamplifier 500 includes capacitor C16 operating as a low pass filter to reduce RFI and the like. Load resistor R14 is connected to the +3V supply thereby supplying operating voltage to the preamplifier 500. Capacitor C14 operates as a high pass filter thereby reducing low frequencies from power line interference and the like. Amplifier 345 comprises operational amplifier U4, negative feedback type, whose high gain configuration is set by resistors R9 and R10. Capacitor C13 is provided to reduce energy consumption. Resistor R11 provide the bias point of the amplifier 345 at +1.25V.

Figures 3E, 3F, 31:
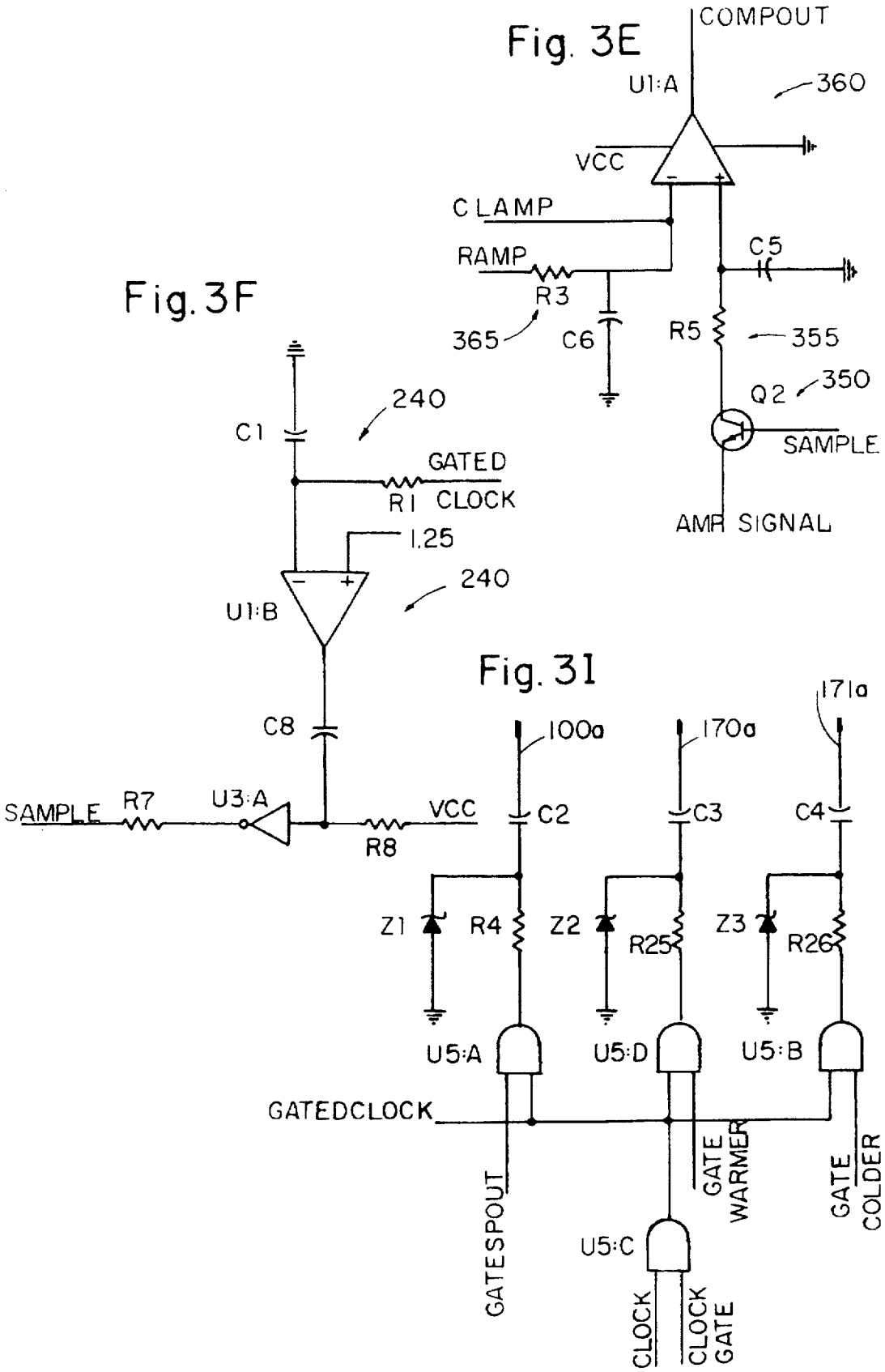

FIG. 3E is a schematic diagram of the signal sampler/detector 350, low-pass filter (LPF) 355, D/A convertor 365 and signal comparator 360. The ampsignal output from the amplifier 345 is supplied to transistor Q2 that operates as a signal sampler. Capacitor C5 operates as the sampling capacitor holds the samples. Resistor R5 in combination with capacitor C5 functions as the LPF 355. Operational amplifier U1:A operates as the signal comparator and is used by the microcontroller 300 to ascertain the signal strength. The D/A convertor 365 comprises the RC configuration including charging resistor R3 and hold capacitor C6. The microcontroller 300 sets the reference via ramp line and may totally discharge the capacitor C6 via the clamp line. Compout line therefore represents the difference between the ampsignal and the reference level set by the microcontroller 300.

FIG. 3F is a schmetic diagram of the phase compensator and sample pulse generator circuit of the sensor electronics 200 that provides a sample pulse via sample line the is phase synchronous with the signal from the receiver antenna 210. It comprises a phase delay comparator U1:B set by capacitor C1 and R1 fed by the gateclock line that makes the signal a square wave. Capacitor C8 differentiates the output of the comparator U1:B, thereby providing a pulse that is buffered by invertor U3:A and resistor R8 (connected to $V_{cc}$) to provide the sample pulse that is supplied to sample transistor Q2 (see FIG. 3E).

Figure 3G:
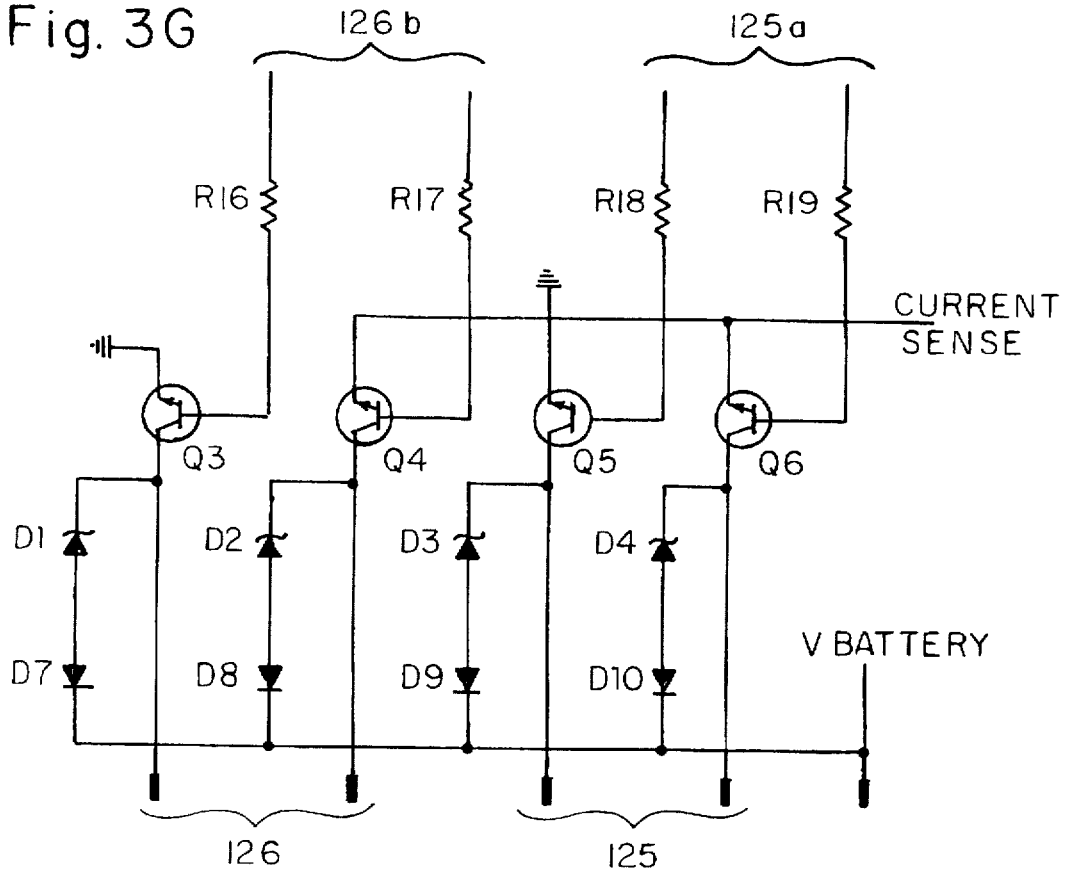
Figure 3H:
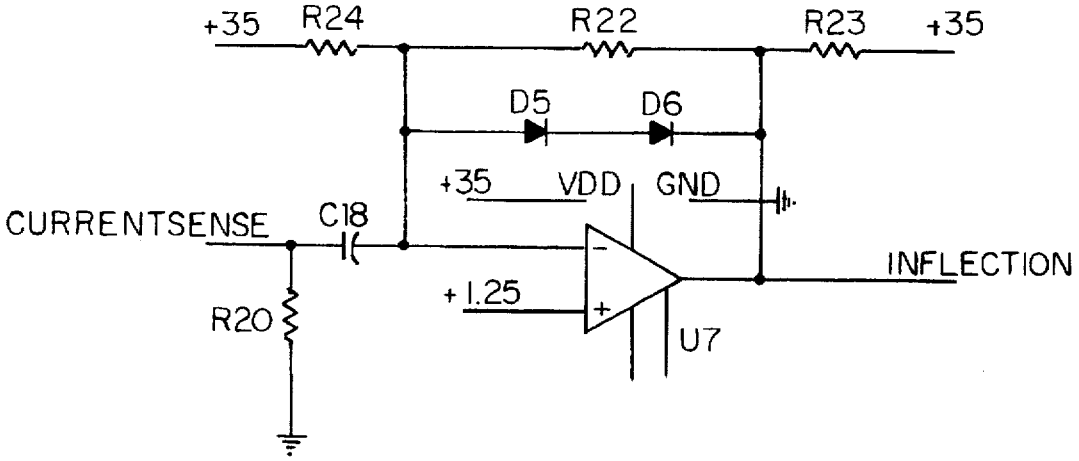

FIG. 3G is a schematic diagram of the solenoid valve drivers and clamps for driving the hot and cold 3-wire solenoid valves 125 and 126, each comprising NPN transistors Q3–Q6 and zenor diodes D1–D4 and diodes D7–D10 that operate as a clamp. Resistors R16–19 connect the transistors Q3–Q6 to the microcontroller 300. It is noted that the currentsense line is connected to the emitters of the transistors Q4 and Q6 connected to the "open" coils and then supplied to the solenoid current inflection detector circuit of FIG. 3H that determines when the valves are fully opened and thereby conserve power.

The solenoid current inflection detector circuit 510 is similar in function to that illustrated and described in connection with FIGS. 4 and 4A-1–4A-3. More particularly, this circuit 510 comprises operational amplifier U7 that inputs the currentsense signal. Resistor R22 and R24 function as a differentiator that cause the amplifier's output to go positive when the currentsense signal begins to decrease (i.e., the first derivative goes negative). Diodes D5 and D6 limit the negative swing of the input voltage. The inflection signal is then supplied to the microcontroller 300.

FIG. 3I is the clock and signal output gates and drivers 10 that energies the spout 100 and the hot and cold touch control pads 170 and 171 comprising AND gates U5:A–D, with gate U5:C being the main control gate and gates US:A,D & B controlling the energization of the spout, hot touch pad and the cold touch pad via lines 100*a*, 170*a*, and 171*a*, respectively. Zenors Z1–Z3 and resistors R4, R25 & R26 provide for electric discharge protection and capacitors C2–C4 provide for DC blockage.

Figure 3J:
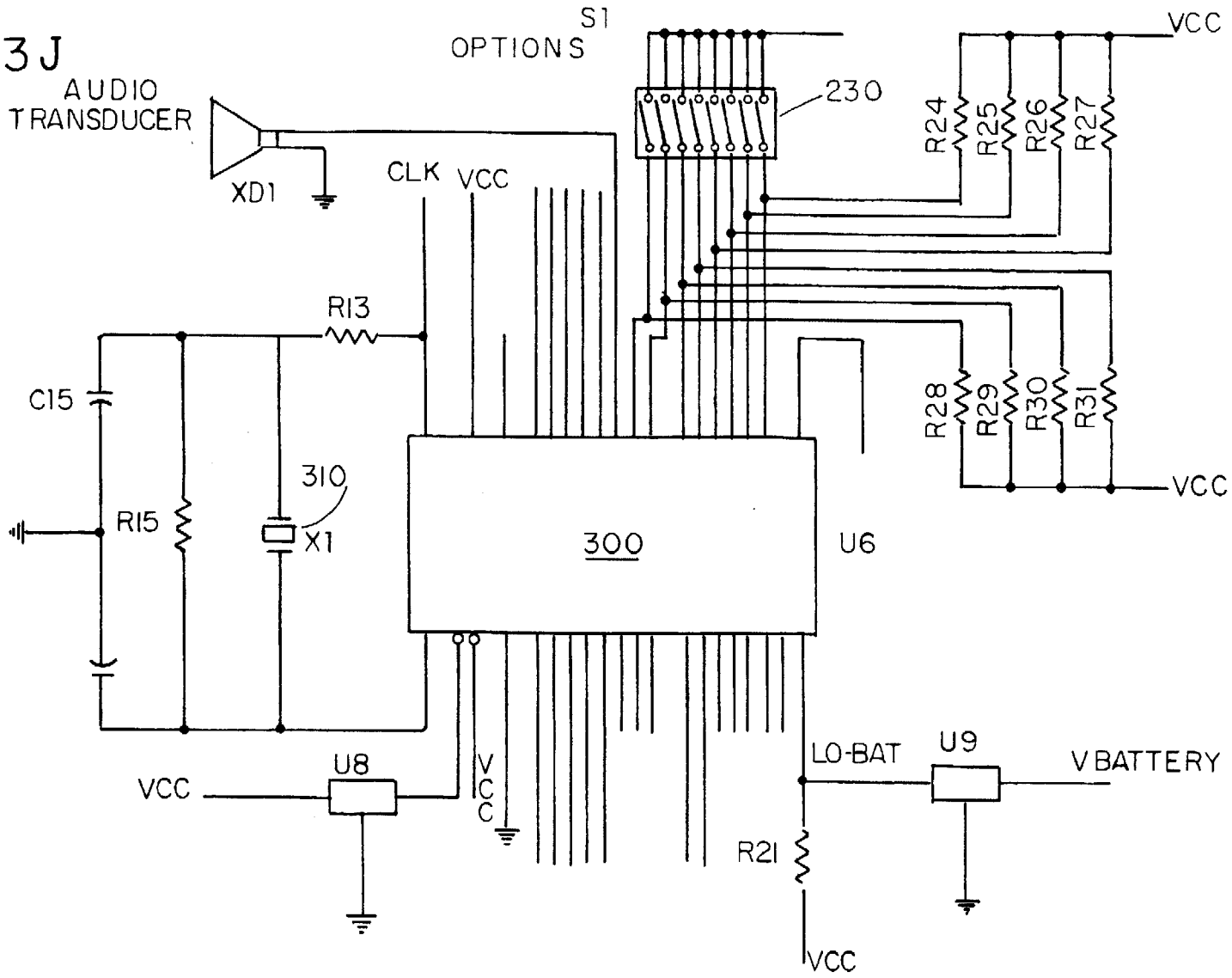
Figures 1, 3K:
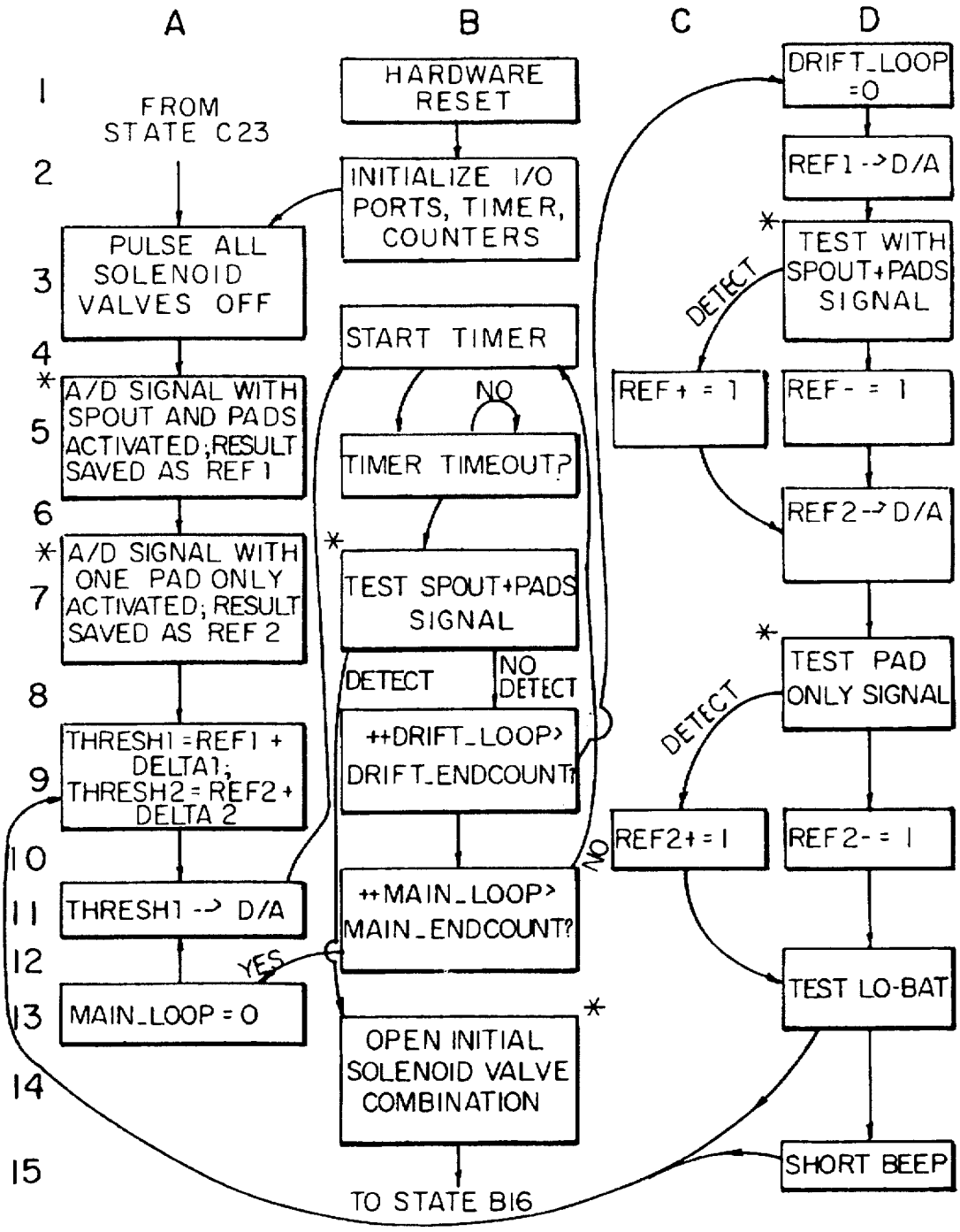
Figures 2, 3K:
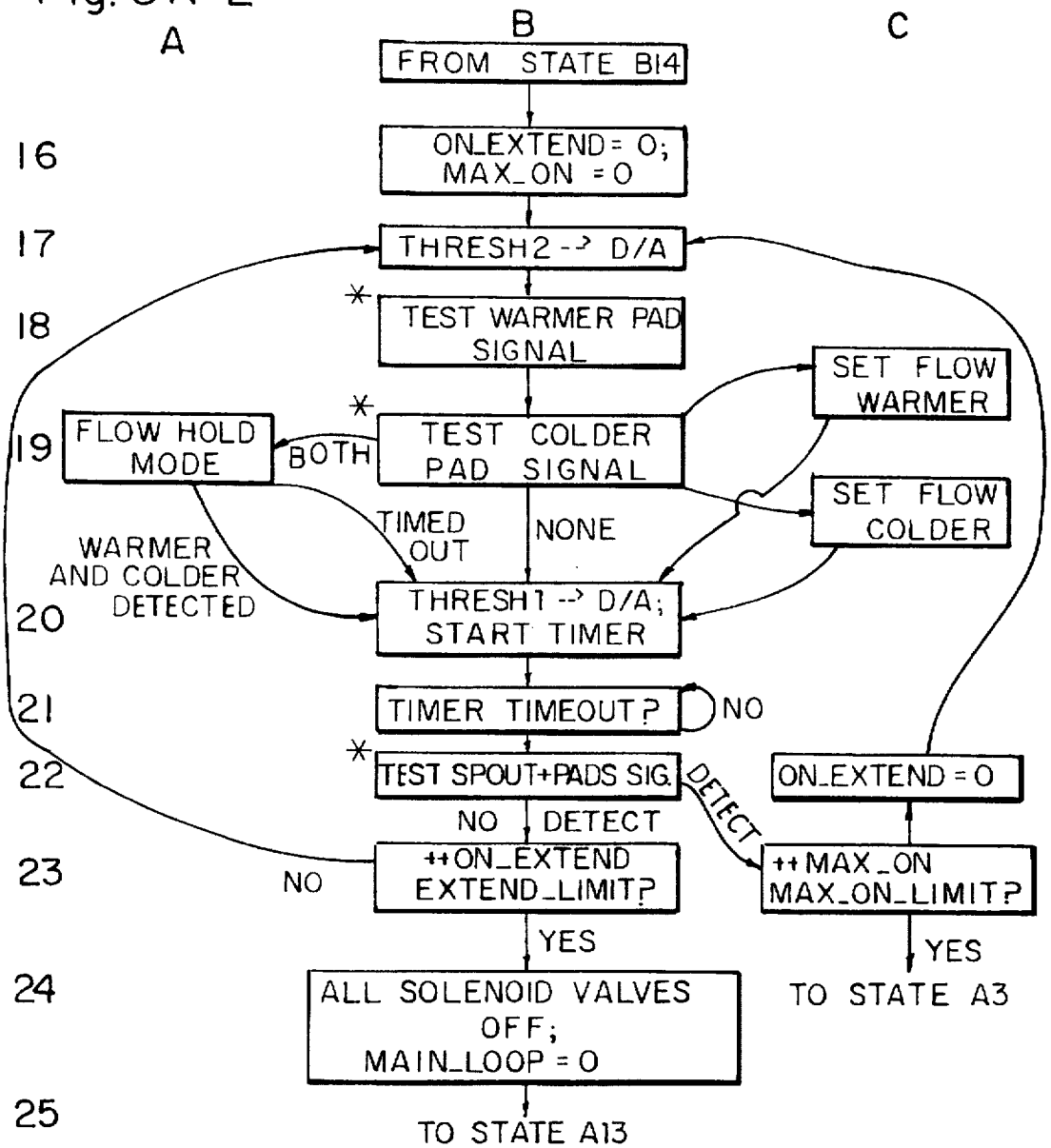

Finally, FIG. 3J is a schmetic diagram of the microcontroller U6 (300), crystal circuit 310 including oscillator X1, capacitors C15 and C17 and resistors R15 and R13, option switches S1 (230) with pull-up resistors R24–R31, low voltage detector U9 that signals the controller 300 when battery supply is low, low voltage reset circuit U8 that resets the microcontroller U6 at low voltage conditions and audible alert XD1 that is actuated at low power conditions.

It may be appreciated by those skilled in the art that there are numerous methods for accomplishing the objective of generating, receiving and processing an oscillating electric signal. The existence of other methods for processing such signals should be considered only as an affirmation that there exist alternative means of accomplishing the same degree of functionality covered by the claims. Also, a basically similar controller 10 could operate using line power and/or emit a continuous electric field rather than an intermittent one. A similar controller 10 could be located to one side of a sink 105 rather than in front behind a vanity 110, or it could be built into the porcelain or plastic of the sink 105 itself. The excitation voltage could be applied to a different object or surface area near or in the sink 105 other than the water spout 100. The sensor electronics 200 can be made very insensitive, so that only by actually touching the spout 100 or other conductive radiator is sufficient field strength coupled to the human body to cause an actuation. The receiver antenna 210 can be placed remotely from the sensor electronics 200 with the use of a connecting shielded cable to the electronics 200 and perhaps with the aid of a preamp to drive the cable if it is long.

Also, it should be noted that the invention described herein may be applied to uses other than water spout control. For example, it could be employed for animal watering, product dispensing of gases, powders or fluids other than water, or for hand driers or other appliances requiring activation upon the detection of human presence. Such applications require little or no deviation from the invention as disclosed herein, and require negligible imagination beyond conventional engineering skills. Accordingly, I claim all modifications and applications such as these as coming within the spirit and scope of the following claims.

I claim:

1. An apparatus for controlling the flow of water through a spout in response to human proximity comprising:

electric field radiator means placed in the vicinity of a sink and excited with an alternating voltage of known frequency by means of an electrical conductor connected to a source of said voltage, said radiator means producing a primary electric field at said known frequency that is coupled to the human's body when a portion thereof enters the primary electric field, the human's body then radiating a secondary electric field in syncopation with the primary electric field;

conductive receiving means responsive to the secondary electric field for converting the secondary electric field to a received electrical signal, the receiving means being located apart from the field radiator means;

amplification means for increasing the power of the received electrical signals to a usable level;

electrical filter means for preferentially passing received electrical signals at said known frequency;

conversion means for converting the filtered and amplified received electrical signals to an electrical representation indicative of a parameter of the received signal such as signal strength or signal phase;

comparison means responsive to the output of the conversion means and to a reference level for generating a detection signal indicative of whether the output of the conversion means is greater or less than the reference level;

actuator control means responsive to the detection signal for controlling an electromechanical actuator used to control the flow of water to the spout;

power supply means for supplying electrical power to the electronic portions of the apparatus.

2. The apparatus of claim 1 wherein the electric field radiator means is the spout itself, the spout being made to radiate the primary electric field.

3. The apparatus of claim 1 wherein the electric field radiator means is a conductive surface adhered to an underside of a region of the sink or a surface adjacent thereto.

4. The apparatus of claim 1 wherein the electric field radiator means is an object capable of passing an electric field to a person, said object being placed in view above the sink or a surface adjacent thereto.

5. The apparatus of claim 1 including metallic shield means, the shield means being formed so as to make the conductive receiving means preferentially sensitive in one or more directions and less sensitive in at least one other direction.

6. The apparatus of claim 1 wherein the degree of change required of the received electrical signal to cause a change in the detection signal is made sufficiently small so as to permit proximity detection of the portion of the human without requiring actual physical contact with the electric field radiator in order to effect a change in the detection signal.

7. The apparatus of claim 1 wherein the degree of change required of the received electrical signal to cause a change in the detection signal is made sufficiently large so as to require an actual physical contact by the portion of the human upon the electric field radiator or a surface attached thereto in order to effect a change in the detection signal.

8. The apparatus of claim 1 further including power supply means for supplying electrical power to said conversion means, said comparison means and said actuator control means, said power supply means shutting power off to at least one of conversion means, said comparison means, and said actuator control means during non-use time intervals.

9. The apparatus of claim 1 wherein said electromechanical actuator comprises a latching magnetic solenoid valve having an electrical solenoid coil actuating means responsive to said actuator control means.

10. The apparatus of claim 9 including control means comprising:

means responsive to a derivative change in current passing through said solenoid coil to generate a binary signal indicative of the occurrence of said change;

timing means to generate a timing signal after a preset timing interval, the length of said interval corresponding to the maximum desired duration of the application of electrical power to said solenoid coil, said timing interval commencing upon the application of power to said solenoid coil; and means responsive to said binary signal and said timing signal to shut off current flow to said solenoid coil upon the occurrence of either said binary signal or said timing signal, which ever occurs first.

11. The apparatus of claim 1 wherein said electromechanical actuator comprises a variable water mixing valve.

12. The apparatus of claim 1 including a plurality of electric field radiator means, each said field radiator means being controlled by additional means comprising:

switch means to independently couple an alternating voltage of known frequency to each said field radiator means;

logic means to control a further operation assigned to each electric field radiator upon detection of a signal by the comparison means during the interval when a specific electric field radiator means is excited by said switch means.

13. The apparatus of claim 12 wherein logic means includes means for recognizing combinations of a plurality of sensed electric field radiator signals, and initiates a further operation in response thereto.

14. The apparatus of claim 12 wherein said further operation includes a change in water temperature effected by means of controlling the operation of said electromechanical actuator capable of causing a change in water temperature by altering the ratio of water supplied from at least two water feed sources to the spout.

15. The apparatus of claim 12 wherein said further operation includes a change in water flow rate effected by means of controlling the operation of said electromechanical actuator capable of controlling water flow volume.

16. The apparatus of claim 12 wherein said further operation includes water flow hold control, whereby the apparatus initiates a timed continuation of water flow for a maximum fixed period of time.

17. The apparatus of claim 12 wherein said further operation includes the control of water flow by means of controlling the operation of said electromechanical actuator capable of turning water flow on and off.

18. The apparatus of claim 1 further including control means for initiating a self-calibration of the apparatus to establish said reference level following power-up.

19. The apparatus of claim 1 further including control means for incrementally changing said reference level slowly over time, by examining said received electrical signal under quiescent conditions and making an incremental adjustment to said reference level depending on whether said received electrical signal is higher or lower than previously.

20. The apparatus of claim 1 further including timing means for timing the duration of water flow, means for shutting off water flow if a preset maximum timing duration is reached, and means for causing a recalibration of the apparatus in order to establish a new said reference level and to resume normal operation upon reaching the maximum timing duration.

21. The apparatus of claim 1 further including a temperature sensing means to monitor the temperature of the water fed to the spout, and means for reading said sensing means for controlling of the water temperature including the limitation of high water temperatures.

22. A method for controlling the flow of water through a spout of a sink in response to human proximity comprising the steps of:

producing a primary electric field at a known frequency proximate to the sink that is coupled to the human's body when a portion thereof enters the primary electric field, the human's body then radiating a secondary electric field in syncopation with the primary electric field;

receiving and converting the secondary electric field to a received electrical signal;

amplifying the power of the received electrical signal to a usable level;

preferentially passing received electrical signals at said known frequency;

converting the received electrical signals to an electrical representation indicative of a parameter of the received signal such as signal strength or signal phase;

generating a detection signal indicative of whether the output of the converted signals is greater or less than a reference level; and controlling an electromechanical actuator used to control the flow of water to the spout located proximate to the sink in response to said detection signal.

* * * * *